United States Patent [19]

Dick

[11] Patent Number: 5,067,700

[45] Date of Patent: Nov. 26, 1991

[54] METHOD AND APPARATUS FOR ATTACHING INSERTS TO MOVING SHEETS

[75] Inventor: David L. Dick, Fostoria, Ohio

[73] Assignee: The Gray Printing Company, Fostoria, Ohio

[21] Appl. No.: 566,553

[22] Filed: Aug. 10, 1990

[51] Int. Cl.[5] ..... B65H 5/30

[52] U.S. Cl. ..... 270/55; 270/54

[58] Field of Search ..... 270/54, 55, 56, 57, 270/58, 53

[56] References Cited

U.S. PATENT DOCUMENTS

| | | | |
|---|---|---|---|
| 3,658,318 | 4/1972 | Bunting | 270/55 |
| 3,663,007 | 5/1972 | Preiter | 270/55 |
| 3,819,173 | 6/1974 | Anderson | 270/54 |
| 4,083,551 | 4/1978 | St. Denis | 270/57 |
| 4,917,367 | 4/1990 | Sterne | 270/54 |

*Primary Examiner*—Edward K. Look

*Assistant Examiner*—Therese M. Newholm

*Attorney, Agent, or Firm*—Melhorn

[57] ABSTRACT

A method and apparatus for attaching an object or insert onto a moving signature on a signature collating machine. The invention comprises a portable insert handling device for readily adapting a typical signature feeder station of a conventional saddle gatherer into an insert feeder station. An adhesive applicator is provided for applying a bead of adhesive to a signature prior to entering the insert feeder station of the invention. The insert handling device is lightweight and easily mounted on the framework of any one of the signature feeder stations and cooperates with the existing feeding mechanism to properly orient a discharged insert relative to a signature moving therebelow. The insert is disposed in an overlying relationship to the adhesive bead. A pressure roller downstream of the feeder station urges the insert against the adhesive bead attaching it to the signature.

25 Claims, 5 Drawing Sheets

METHOD AND APPARATUS FOR ATTACHING INSERTS TO MOVING SHEETS

FIELD OF THE INVENTION

This invention relates generally to attaching inserts to moving sheets and more particularly to the attaching of inserts onto signatures on a signature gathering apparatus.

DESCRIPTION OF THE PRIOR ART

The assembly and binding of relatively thin books. magazines and the like are typically performed by a number of automated systems. The systems, generally, are a continuous operation and include a number of signature feeding stations and collating means for collecting the signatures for advancement to binding and trimming stations. One such system that has been proven highly successful in the industry is the saddle gatherer system. The system includes a conveyor comprising a stationary horizontal portion referred to as a saddle, having an inverted V-shape for receiving partially opened signatures from a plurality of associated spaced apart feeding stations. A driven endless chain extends along the top of the saddle and includes a series of outwardly extending spaced apart projections or carriers which function to collect and advance the signatures in a superimposing manner as the chain advances past the feeding stations. The collated signatures are successively advanced for further processing to the stitching and trimming stations.

It is frequently desirable to include a supplementary insert, such as a card, envelope, or other printed material between the pages of a magazine or like publication. The insert, can be positioned loosely in the magazine or affixed by stitching or a suitable adhesive. Generally, when utilizing an adhesive, one is chosen that will securely hold the insert in place during handling, while at the same time permit easy removal by a purchaser when desired.

The attaching of an insert onto a signature is commonly referred to in the industry as tipping. Manual as well as automated systems have been devised over the years for feeding inserts between the pages of a magazine. Machines have been designed for feeding both loose inserts as well as those that are attached to a page of the magazine. Limited success has been realized integrating an insert feeding machine with a signature collating or gathering line. In some instances, the machines are designed to utilize an existing signature feeding station while others comprise an independent unit or line that operates in harmony with the signature collating line. Unfortunately, the time involved in setting up some of the present day machines discourages use on smaller runs causing the operator to rely more on an off-line manual operation. The manual operation is typically a relatively expensive operation due to the additional personnel required and the additional time needed to manually feed and align the inserts.

The initial expense as well as the relatively large physical size of currently available machines for achieving the desired objectives are factors which discourage the use of such machines, especially when only infrequently utilized.

An on-line tipping apparatus is disclosed in U.S. Pat. No. 4,083,551 for attaching an insert onto a moving signature of a conventional signature collating system. The inserts are fed from a standard signature hopper onto an auxiliary conveyor for movement in timed and spaced relationship to a signature carried by the main conveyor. Adhesive is applied to the signature as it moves along the main conveyor after which time an insert carried by the auxiliary conveyor is brought into contact with the adhesive and firmly held against the signature. A pair of rollers may be provided to apply pressure to the signature and insert to promote adherence of the insert to the signature.

U.S. Pat. Nos. 3,371,924 and 3,826,706 disclose apparatus for gluing inserts or object onto moving signatures in a signature collating operation. In the former, an insert tipping apparatus is slidably supported on rails and longitudinally adjustable relative to the signature transfer boxes of the gathering machine. The insert tipping apparatus includes a storage box and feeding mechanism for the synchronized feeding and positioning of an insert relative to a signature. Means is provided for applying an adhesive to each insert prior to engagement with a signature after which the two are advanced between a pair of nip rollers where pressure is supplied to secure the insert to the signature U.S. Pat. No. 3,826,706 discloses a self-supporting insert feeding apparatus that includes an adhesive applicator for applying adhesive to the insert and a drum for exerting pressure on the insert after it is aligned with the signature to affix the insert thereto. Each of the patents utilize a distinct insert storage tray and feeding mechanism that is not normally associated with a signature gathering machine.

An apparatus for the insertion of loose inserts into moving signatures of a conventional collecting and binding device is disclosed in U.S. Pat. No. 3,663.007. The apparatus utilizes one of the signature feed mechanism to store and feed the inserts and a special catching device for aligning and guiding the inserts into a predetermined position relative to the signatures. The device includes a rail which is adapted to extend to the binding station for supporting the advancing insert along the conveyor.

SUMMARY OF THE INVENTION

The present invention alleviates the above-noted shortcomings of the prior art devices by providing an improved method and apparatus for attaching inserts onto a moving signature on a conventional saddle gathering machine while making maximum use of existing equipment. The apparatus is adapted to convert an existing signature feeder station into one for feeding inserts and includes a device for catching a discharged insert and positioning it relative to the moving signature or stack of signatures. The device is comprised of a minimum number of parts, lightweight, and easily mounted on the framework of the selected feeder station. The apparatus also includes a glue gun attachment readily mountable onto the framework of the preceding feeder station or other suitable location. A bead of adhesive is applied to a signature as it is being carried on the saddle gatherer just prior to its advancement into the insert feeder station. An insert is discharged onto the signature and as the assembly is carried from the feeder station it passes under a pressure roller to promote adherence of the insert to the signature. Air nozzles may be disposed to direct a flow of mild air pressure to the back side of the insert as it is being discharged by the feeding drums to assure that the leading edge of the insert assumes the desired path of travel.

It is therefore a primary object of the present invention to provide an improved method and apparatus for the on-line attaching of inserts onto signatures on a conventional saddle gathering machine.

Another object of the invention is to provide such apparatus making maximum use of existing equipment.

Another object of the invention is to provide such an apparatus employing a minimum number of components which are easy to install and economical and easy to maintain.

Yet another object of the invention is to provide such an apparatus wherein the components may be readily attached to existing equipment in a minimum of time by an operator having ordinary skills.

Still another object of the invention is to provide such an apparatus that is readily adjustable and capable of handling a large variety of inserts.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DETAILED DESCRIPTION OF THE PREFERRED EMBODIMENT

Figure 1:
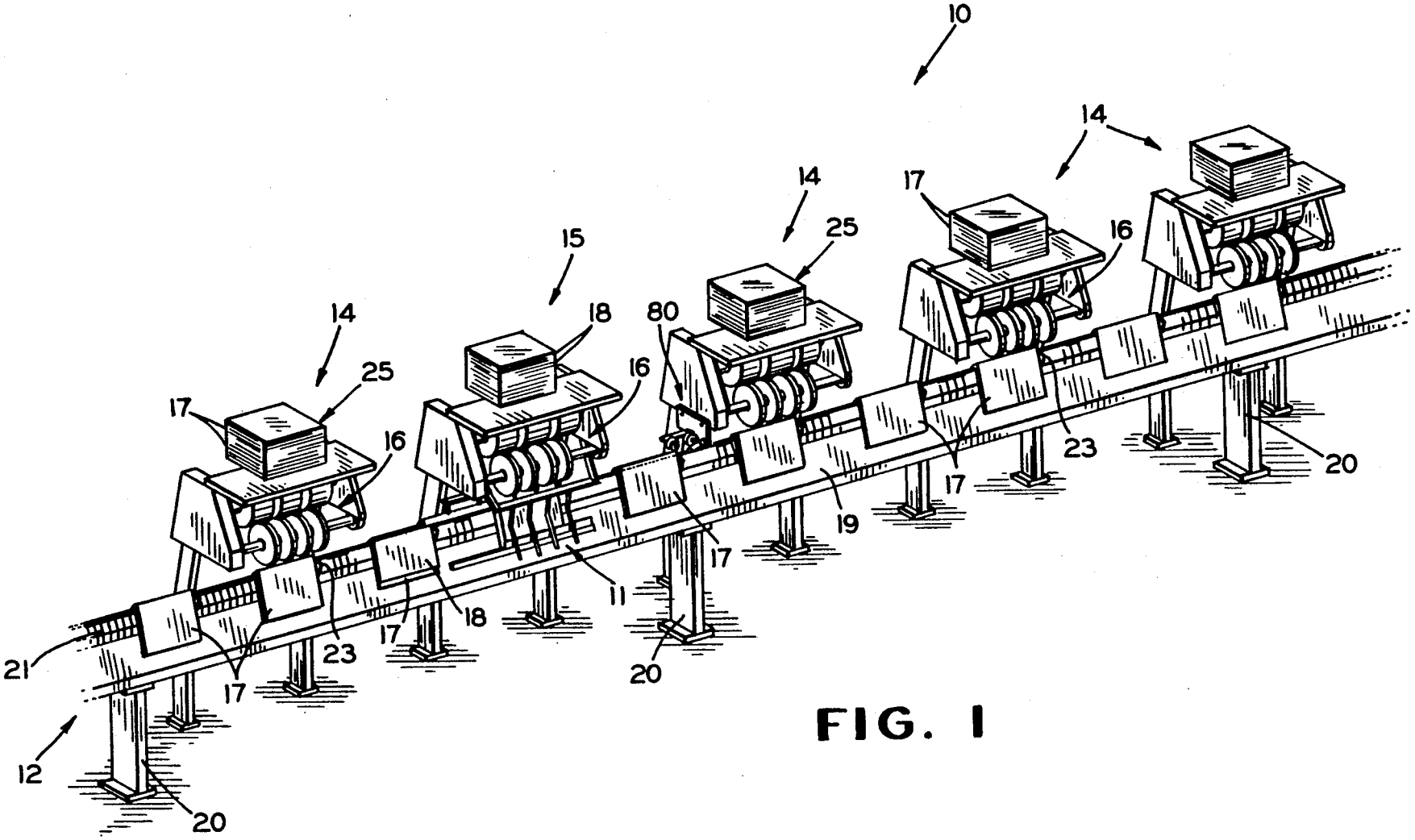
FIG. 1 is a diagrammatic fragmentary perspective view of a conventional saddle conveyor of a signature collating system embodying the novel insert attaching apparatus of the invention.

Referring now in detail to the drawings, there is illustrated in FIG. 1 a diagrammatic representation of a conventional signature gathering system, generally designated 10, incorporating the insert handling apparatus 11 of the present invention. The signature gathering system 10 comprising a saddle conveyor 12, a plurality of signature feeder stations 14 and an insert feeder station 15. While the invention will be described in connection with the saddle conveyor 12 depicted in the drawings, it is understood that the insert handling apparatus 11 of this invention is not restricted to such a conveyor system,. but also has utility in other conveyor systems for transporting signatures or sheets in a generally vertical or upright disposition. The feeder stations 14 and 15 are spaced longitudinally to one side of the saddle conveyor 12 and each include similar mechanism 16 for feeding, or depositing, folded signatures 17 and inserts 18, respectively, seriatim on the saddle conveyor. The folded signatures 17 are disposed on the conveyor in a partially opened manner with the folded edge uppermost, as will hereinafter be more fully described.

Figure 2:
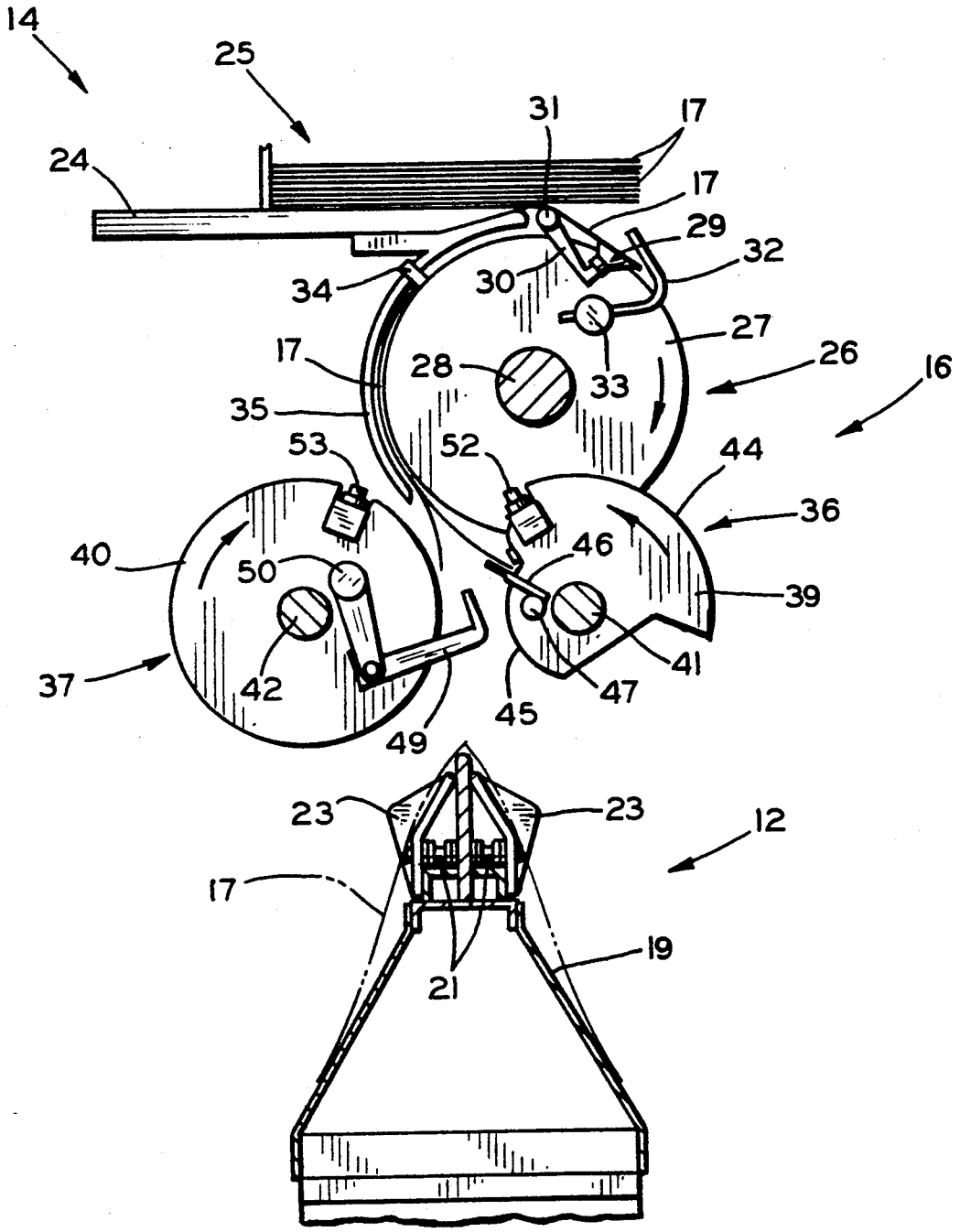
FIG. 2 is a diagrammatic fragmentary sectional view illustrating the signature feeding means and saddle conveyor of a conventional signature collating system.

The saddle conveyor 12, as is well known in the industry, includes an elongated horizontally extending saddle portion 19, which has a generally inverted V-shape crosssection and is supported by a plurality of stanchions 20. A pair of endless chains 21 driven in unison by a suitable power unit (not shown) have their upper run supported along the top of the saddle 19, as best shown in FIG. 2. A series of outwardly extending opposed pojections, or carriers 23, are suitable, spaced along the chains 21 to successively collect and advance the folded signatures 17 in a superimposed, stacked relationship as the chains travel past the feeder stations 14. The trailing edges of the collated signatures re aligned with one another as they are collected by the carriers 23 so they are in the proper disposition as they advance to the subsequent binding and trimming stations (not shown) for final processing.

A saddle stitching line comprises several signature feeder stations and, typically, includes a sufficient number of stations to handle a majority, if not all, assembly operations. Of course, the number of stations utilized in an operation is determined by the number of pages in the publication being assembled. More often than not, at least one of the feeder stations is not needed in a particular run and is inactive. As previously mentioned, oftentimes it is required that an insert be attached to one of the pages of a publication being assembled. Due to the lack of a practical and economical mechanism for performing this task on-line, generally, it is performed off-line at a considerable added expense. The present invention provides a relatively simple and economical apparatus for readily converting one of the inactive signature feeder stations to one for automatically feeding and attaching inserts to moving signatures.

The operation of a typical signature feeder station will now be described with reference to the diagrammatic representation shown in FIG. 2. The feeder station 14 includes a platform 24 for supporting a vertical stack 25 of folded signatures 17. The signatures are arranged with their folded edge to the rear of the stack, i.e., the right side as seen in the illustration, in an overhanging relationship to the platforms 24. A transfer assembly 26 comprising. generally, two or three spaced drums 27 coaxially mounted on a shaft 28 is located directly below the stack 25 of folded signatures 18. A vacuum cup 29 disposed below the overhanging portion of the stack of signatures is attached to an arm 30 pivotally mounted on shaft 31. The vacuum cup 29 is operable to grippingly engage the lowermost signature 17 of the stack 25 adjacent the folded edge and pull it downward toward the transfer assembly 26. The gripping and separating of the folded edge of the signature from the stack 25 is accomplished in timed relationship with the continuously rotating drums 27. A shown in FIG. 2, the drums 27 rotate in a clockwise direction and include, generally, a pair of gripper levers 32, pivotally mounted between the spaced drums 27 for rotation therewith, on a shaft 33. The gripper levers 32 are typically controlled by a cam and follower arrangement (not shown) in timed sequence with rotation of the drums 27, to grip the folded edge of a signature 18 as it is separated and drawn downward from the stack 25 by the vacuum cup 29. Thus, as the drums 27 continue to rotate, the signature 17 is carried by the drums away from the platform 24 separating it from the remainder of the stack 25. An adjustable stop member 34 is positioned to halt rotation of the signature 17 at a predetermined point at which time the gripper levers 32 are once again activated to release the signature 17. An arcuate guide 35, associated with the stop member 34, maintains the signature in close proximity to the drum members 27 after its release by the gripper levers 31.

A pair of roller assemblies, 36 and 37, as is well known in the art, cooperate to intercept the released signature 17 and deposit it on the saddle conveyor 12. To this end, the roller assemblies 36 and 37, are comprised of a set of disks 39 and 40, respectively, mounted in spaced axial relationship on respective shafts 41 and 42. A drive means (not shown) is provided for rotating the roller assemblies 36 and 37 in synchronization with the drums 27. The assembly 36 rotating in a counter clockwise manner and the assembly 37 in a clockwise manner with respect to FIG. 2.

The disks 39 have a first semicircular portion 44 and a second semicircular portion 45 of reduced diameter which facilitates entrance of the signature into the nip area of the roller assemblies 36 and 37. A gripper 46 is pivotally mounted on a shaft 47 adjacent the reduced semicircular portion 45 of at least one of the disks 39. The transfer and roller assemblies, 26 and 36, respectively, are synchronized such that as a signature is released by the grippers 32, the gripper 46 is in position to engage the inboard edge of a first leaf of the signature 17. At this time, and activating mechanism, such as a cam/follower arrangement (not shown). rotates the gripper 46 to seize the lower edge of the leaf. As the roller assembly 36 continues to rotate in a counter clockwise manner the signature 18 is drawn downward to a point where the other or second leaf of the signature is caught by a catching device 49 on the roller assembly 37. Generally, a plurality of the catching devices 49 are provided and pivotally mounted between adjacent disks 40 on a shaft 50. The roller assembly 37 further includes suitable mechanism (not shown) that rotates the catching device 49 to grippingly engage the second leaf of the signature.

The roller assemblies 36 and 37 include suction cups 52 and 53, respectively, that are activated to grip the respective leaves of the signature 17 as it is drawn downward between the two roller assemblies. As the roller assemblies 36 and 37 continue to rotate with the two leaves secured thereto, the signature 17 is pulled progressively apart and downwardly from the transfer assembly 26. When the signature reaches a predetermined point, the gripping mechanisms 46 and 49 and the vacuum to the vacuum cups 52 and 53 is released, dropping the partially opened signatures 17 onto the saddle conveyor 12 as shown in phantom in FIG. 2. The trailing edge of the signature 17 is then engaged by the continuously moving carriers 23 and advanced along the conveyor 12.

All the feeder stations 14, as is well recognized in the art, are substantially identical and in synchronous operation with the conveyor 12. Thus, as the signatures 17 are deposited in proper sequence onto the conveyor 12, they are gathered, or collected, by the carriers 23 forming a collated set of signatures that are advanced along the conveyor to the final processing stations.

As previously mentioned, oftentimes, at least one of the signature feeder stations is not needed and sits idle during a particular run. The present invention provides an apparatus for readily converting a signature feeder station to one for feeding inserts when the need arises. As will hereinafter be explained, the apparatus is lightweight, easily mounted on the framework of the feeder station in a minimum of time, and makes maximum use of the existing feeding mechanism.

Figure 3:
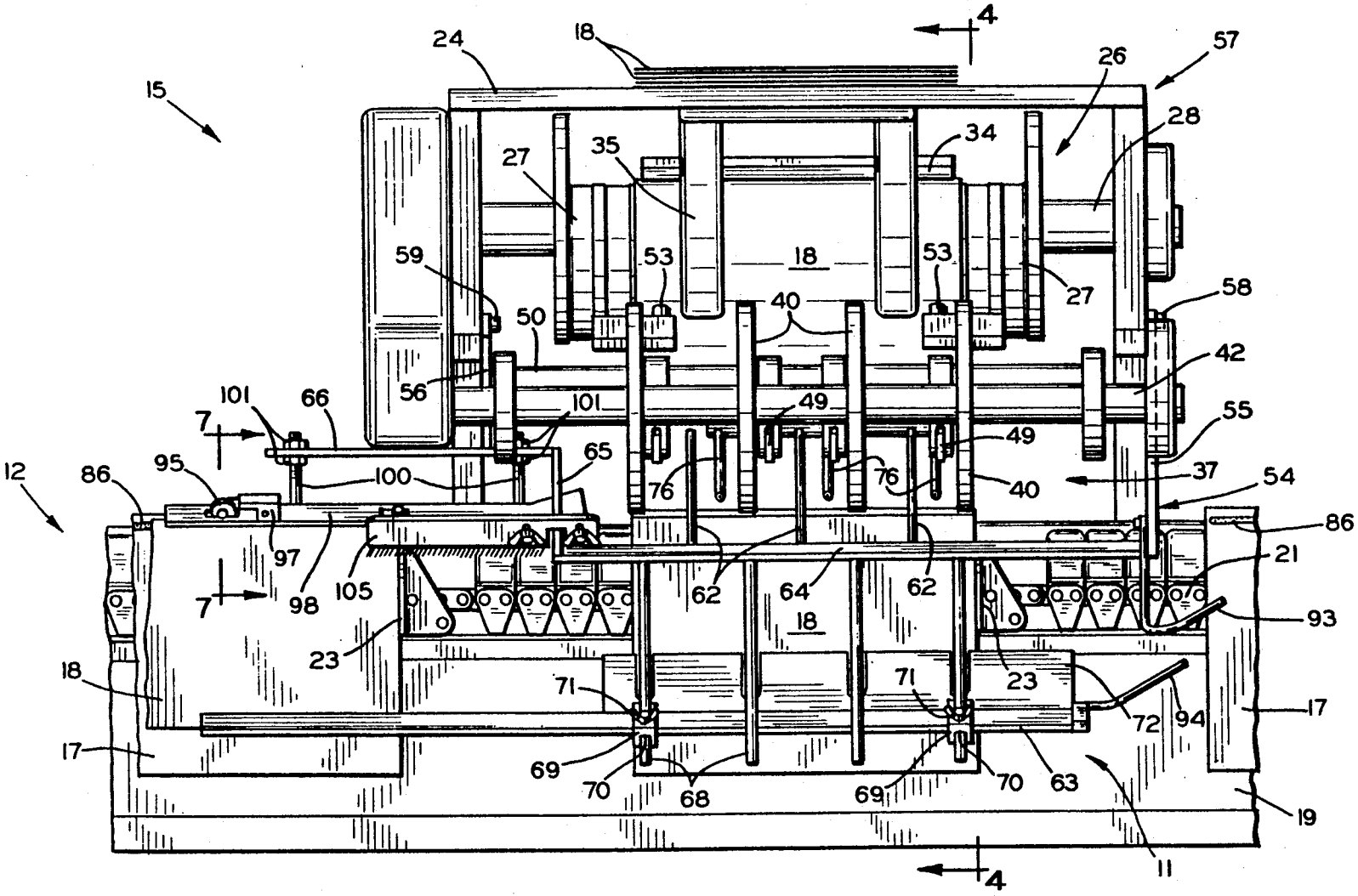
FIG. 3 is an enlarged elevational view of the insert attaching apparatus of the invention in its operative position mounted on a conventional signature feeding apparatus.
Figure 4:
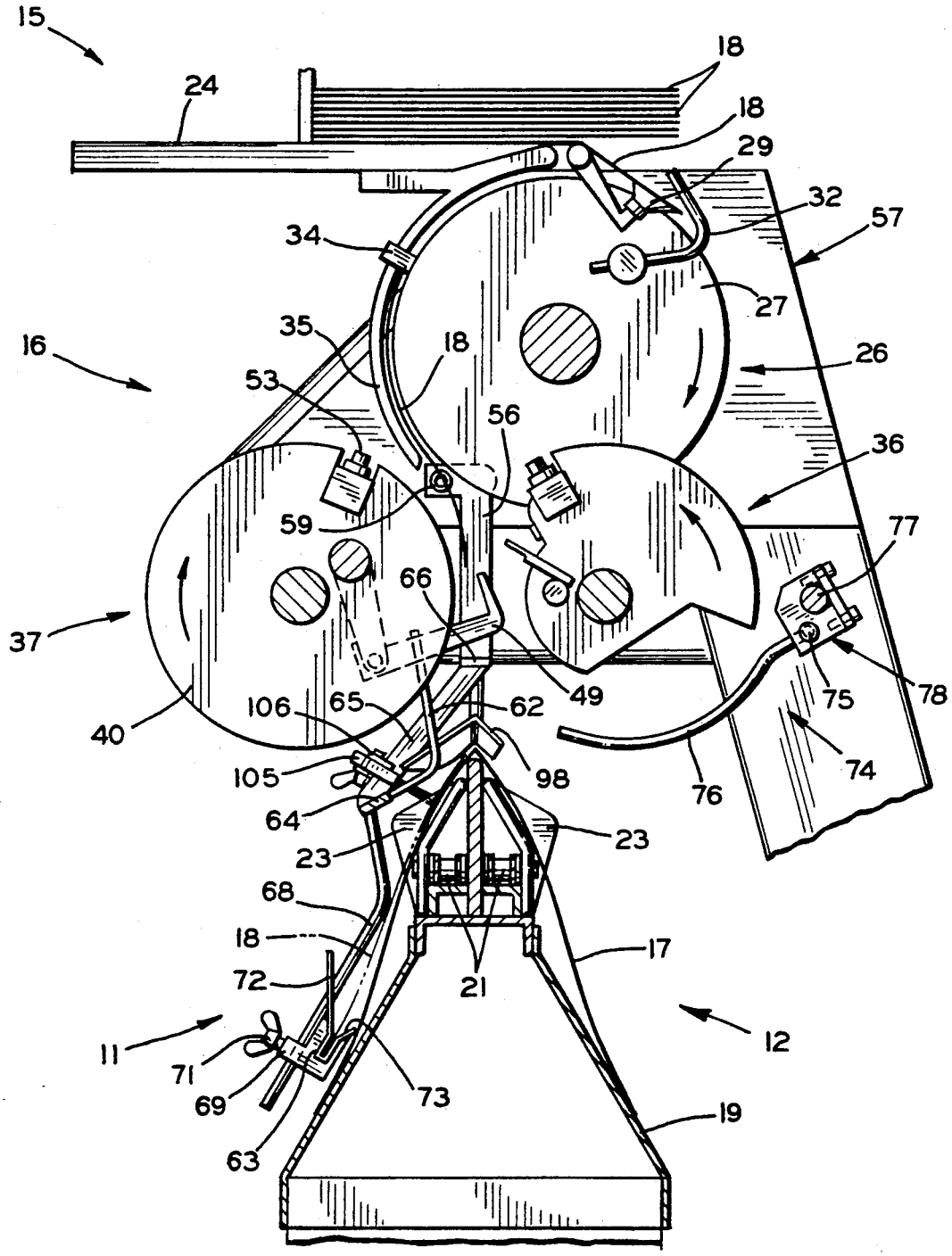
FIG. 4 is an enlarged fragmentary sectional view taken substantially along line 4—4 of FIG. 3.

With reference to FIGS. 3 and 4, there is shown in greater detail, the insert handling apparatus 11 of the invention mounted on a typical signature feeder station converting it into a station for feeding inserts. The apparatus 11 is designed for catching an insert 18 discharged from the feed mechanism 16 and properly aligning it relative to a signature 17 moving therebelow. The apparatus further includes means for adhesively attaching the insert 18 to the signature 17 in a continuous operation.

As will presently be described, the inserts 18 are discharged towards the saddle conveyor 12 by the feed mechanism 16 in much the same manner as the signatures 17. To this end, a stack of inserts 18 are properly disposed in an overhanging manner on the platform 24. In timed sequence, the vacuum cup 29 grips the lowermost insert 18 of the stack and pulls it downward toward the rotating drums 27 of the transfer assembly 26 where it is grippingly held thereagainst by the levers 32. The insert 18 is separated from the stack and carried by the rotating drums 27 until it contacts the stop member 34 at which time it is released by the gripper levers 32. The vacuum cups 53 grip the lower edge of the insert 18 a the roller assembly continues to rotate and pull the insert 18 downwardly from the transfer assembly 26. The insert 18 is released by the suction cups 53 at a predetermined point of rotation causing the insert 18 to fall freely toward the saddle conveyor 12. The roller assembly 36 serves no functional purpose in the insert feeding operation. As previously discussed,it cooperates with the roller assembly 37 to open the leaves of the signature on its decent toward the saddle conveyor.

The insert handling apparatus 11 is positioned to intercept the free falling insert 18 and comprises a frame 54 having brackets 55 and 56 conveniently mounted to the support structure 5; of the insert feeder station 15 by means of suitable fasteners 58 and 59, respectively. The apparatus 11 includes a plurality of upwardly extending tines 62, or other suitable projections, that are disposed between the disks 40 to strip the insert 18 from the roller assembly 37 and guide it on its downward path toward a receiving trough 63. The tines 62 are affixed at their lowermost ends to an elongated bar 64 suitably affixed, as by welding, at one end to the bracket 55 and the other end indirectly to bracket 56 by conjoining members 65 and 66, respectively. Depending from the bar 64 is a plurality of downwardly extending rods 68 that provide an adjustable support for the trough 63. To this end, the trough 63 includes mounting blocks 69 provided with suitable openings 70 for slidably receiving the rods 68. Thus, it is apparent that the trough 63 can readily be positioned on the rods 68 at the level desired. Set screws 71 are provided to maintain the trough at the desired elevation. A longitudinal portion of the trough 63 is provided with diverging side walls 72 and 73 to insure the insert 18 is properly guided into the trough 63 on its downward descent.

An air nozzle assembly 74 comprising a manifold 75, connected to a source of air pressure (not shown), and individual nozzles 76, is mounted on a shaft 77 of the support structure 57 by a suitable bracket means 78 The nozzles 75 are arranged to direct a gentle flow of air to the back side of the insert 18 as it is stripped from the roller assembly 37 to maintain it in contact with the tines 62 when it begins its free fall toward the trough 63.

It is readily apparent, as best shown in FIG. 4, that the shape and positioning of the tines 62 and rods 68 together with the diverging walls 73 and 74 of trough 63 and the previously deposited signature 17, provide a substantially unobstructed path for the insert 18 to enter the trough 63, once the insert 18 enters the trough it advanced with the signature or stack of signatures 17, whatever the case may be, along the saddle conveyor 12 by the carriers 23.

Figure 5:
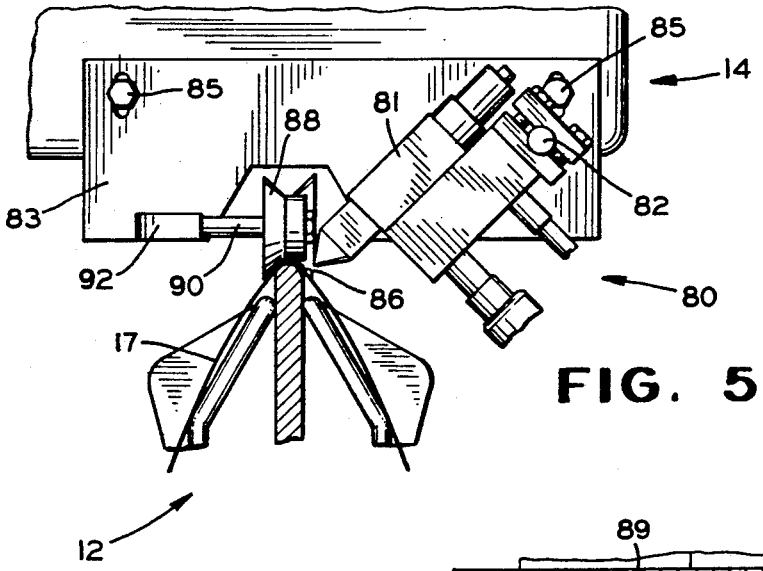
FIG. 5 is an enlarged fragmentary vertical section illustrating the adhesive applicator of the invention.
Figure 6:
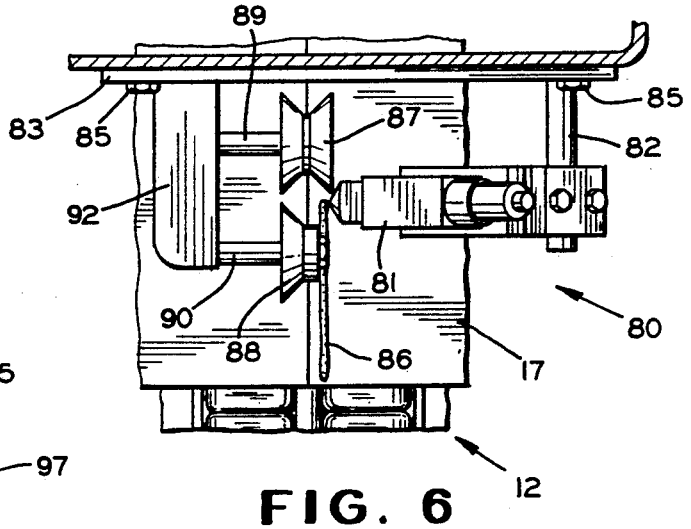
FIG. 6 is a top plan view of the adhesive applicator.
Figure 7:
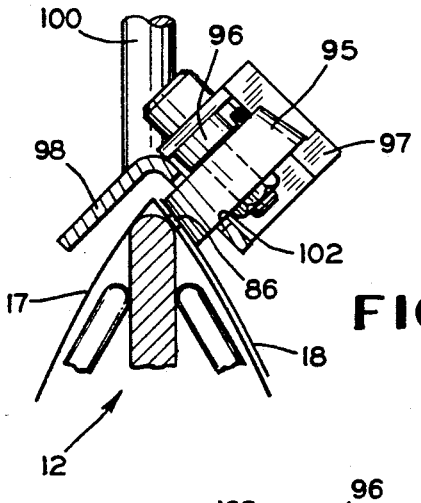
FIG. 7 is an enlarged fragmentary vertical section taken substantially along line 7—7 of FIG. 3 illustrating the pressure roller of the invention.

In order to attach the insert onto the face of a signature, an adhesive applicator 80 is provided upstream the insert feeder station 15. The applicator 80, although not restricted thereto, is conveniently mounted on the framework of the preceding feeder station 14. With reference to FIGS. 5 and 6, the applicator 80 comprises a conventional hot-melt glue gun 81 adjustably mounted on a post 82 affixed to bracket 83 which is secured to the framework of feeder station 14 by suitable fasteners 85. The glue gun 81 is positioned to apply an adhesive bead 86 in a generally horizontal line at a predetermined location on the signature 17. The adhesive bead 86, although not restricted thereto, is normally applied adjacent the folded edge of the signature as illustrated in the drawings.

To insure the accurate placement of the adhesive bead 86 on the signature 17, a pair of rollers 87 and 88 are properly positioned above the conveyor 12 to maintain the folded edge of the signature 17 in axially alignment with the centerline of the conveyor and in a substantially horizontal orientation as it advances past the glue gun 81. The rollers 87 and 88 are disposed on either side of the glue gun 81 and mounted for rotation on axles 89 and 90, respectively. The axles are affixed to a support member 92 suitably attached, as by welding, to the bracket 83. The roller 87 is a convention V-type roller and the roller 88 a modified V type roller with one wall removed so as not to interfere with the deposited adhesive bead 86. The diverging walls of the rollers tend to center the folded edge of the signature as it passes there-beneath properly aligning it with respect to the centerline of the conveyor as it advances past the glue gun 81.

With particular reference to FIG. 3, the insert handling apparatus 11 includes a pair of guide fingers 93 and 94 to properly direct the signature 17 as it enters the insert feeder station 15. In operation, as the signature 17 with an adhesive bead 86 is advanced past the feed mechanism 16 by the carriers 23, an insert 18 is deposited thereon with the upper edge overlying the adhesive bead 86 and the lower edge supported in the trough 63. The signature 17 with the overlying insert 18 supported by trough 63, is advanced past a pressure roller 96 in line with the adhesive bead 86 urging the insert 18 thereagainst securely attaching it to the signature 17.

Figure 8:
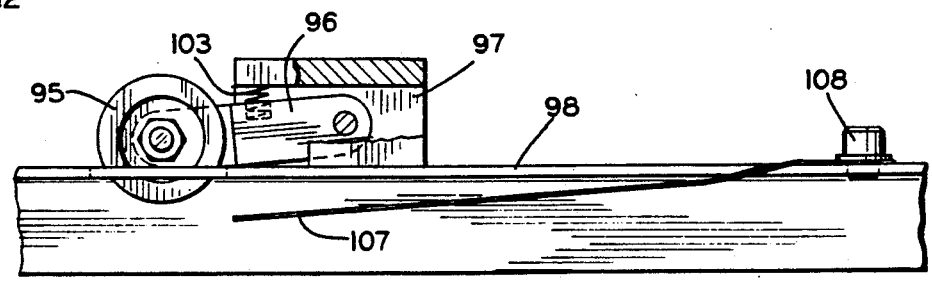
FIG. 8 is an enlarged fragmentary elevational view, partly in suction, illustrating the pressure roll and associated leaf spring.

The pressure roller 95, as best shown in FIGS. 3. 7 and 8, is rotatably mounted on an arm 96 to a pivot block 97 attached to an elongated inverted V-shape guide 98 suspended from the member 66 by threaded studs 100 and lock nuts 101. The roller 95 extends through an opening 102 in the guide 98 and is urged inwardly, i.e., toward the conveyor 12, by a helical tension spring 103. The bristles of an elongated brush 105, adjustably mounted on a plate 106 affixed to the member 65, urges the insert 18 against the signature 17 to insure that the upper end of the insert is in the proper disposition with respect to the adhesive bead 86 as it approaches the pressure roller 95. A leaf spring 107 (FIG. 8) secured to the guide 98 by a fastener 108 extends through an appropriate opening in the guide 98 maintaining this relationship as the assembly engages the pressure roller 95. The spaced relationship between the elongated guide 98 and the apex of the conveyor 12 is readily adjustable by manipulation of lock nuts 101 on threaded studs 100 to accommodate collated assemblies or stacks of various thicknesses.

The insert handling apparatus 11 of the present invention has been described with respect to the attachment of inserts to the front face of a folded signature on a signature gathering machine. However, it is contemplated that a mirror image of the handling apparatus of the invention may be provided for attaching inserts to the outer face of the second leaf of the folded signature, if desired, without departing from the scope of the invention. The apparatus can be mounted and operate in much the same manner as hereinabove described. Likewise, the invention is not restricted to folded signatures but also has utility for attaching inserts to unfolded signatures or sheets as well.

It is to be understood that the form of the invention herein shown and described is to be taken as a preferred embodiment only of the same, and that various changes in the size, shape and arrangement of parts, as well as various procedural changes may be made without departing from the spirit of the invention or the scope of the following claims

What is claimed is:

1. A portable insert handling apparatus for attachment to a signature feeding station, the signature feeding station including a support structure, feeding means for transferring signatures seriatim from a supply stack to a horizontally extending conveyor disposed therebelow, the feeding means including a roller assembly having a plurality of rotating disks axially mounted in spaced relationship on a shaft, the plurality of rotating disks having circumferential surfaces for supporting the signatures as the same are transferred from the supply stack to the horizontally extending conveyor, wherein the handling apparatus comprises:

a frame adapted for mounting on the support structure of the signature feeding station, said frame including a projecting member having one end affixed thereto and the other end disposed between an adjacent pair of the plurality of disks;

support means for supporting the insert in a generally horizontal disposition; and pressure means for engaging the insert supported on said support means.

2. A portable insert handling apparatus as claimed in claim 1, wherein said support means comprises an elongated trough including adjustment means for adjusting the vertical disposition of said trough relative to said frame.

3. A portable insert handling apparatus as claimed in claim 2, wherein said adjustment means comprises a downwardly extending rod affixed at one end to said frame, a mounting block affixed to said trough and including an opening for receiving said downwardly extending rod, and means for securing said mounting block to said downwardly extending rod.

4. A portable insert handling apparatus as claimed in claim 1, wherein said pressure means comprises a roller and means for urging said roller against the insert.

5. A portable insert handling apparatus as claimed in claim 4, wherein said pressure means comprises an elongated leaf spring disposed to exert a force against the insert.

6. A portable insert handling apparatus as claimed in claim 4, wherein said pressure means comprises an elongated brush having a plurality of bristles disposed to exert a force against the insert.

7. A portable insert handling apparatus as claimed in claim 5, wherein said pressure means further comprises an elongated brush adjacent said elongated leaf spring and having a plurality of bristles disposed to exert a force against the insert.

8. A portable insert handling apparatus as claimed in claim 5, wherein said roller and said elongated leaf spring include means for providing vertical adjustment relative to said frame.

9. A portable insert handling apparatus as claimed in claim 3, including a nozzle for directing an air stream against the insert.

10. A portable insert handling apparatus as claimed in claim 9, wherein said elongated trough includes outwardly extending sidewalls and said projecting member, said downwardly extending rod and said nozzle are so disposed to properly guide the insert in a descending path from the feeding means to said elongated trough.

11. An apparatus for attaching an insert to a signature comprising:

a conveyor for advancing a signature along a generally horizontal path;

a signature feeder station for depositing the signature on said conveyor;

means for applying an adhesive to a surface of the signature;

an insert feeder station including feeding means for discharging an insert onto the adhesive on the surface of the signature, said feeding means including a roller assembly having a plurality of rotating disks axially mounted in spaced relationship on a shaft, the plurality of rotating disks having circumferential surfaces for supporting the outwardly facing surface of the insert as it is discharged toward the signature;

means for aligning the insert relative to the signature to cause the insert to overly the adhesive on the surface of the signature, said means for aligning including a projecting member extending between an adjacent pair of the plurality of disks for stripping the insert from said rotating disks; and pressure means urging the insert against the adhesive on the surface of the signature to assure adhesion between the insert and the signature.

12. An apparatus as claimed in claim 11, including a nozzle for directing an air stream against the insert to facilitate the removal thereof from said rotating disks.

13. An apparatus as claimed in claim 11, wherein said insert handling device includes an elongate trough disposed for supporting the lower edge of the insert as the insert rests against the surface of the signature and is moved therewith on said conveyor.

14. An apparatus as claimed in claim 13, wherein said elongate trough includes adjustment means for effecting vertical adjustment.

15. An apparatus as claimed in claim 11, wherein said pressure means comprises a roller and means for urging said roller toward the insert.

16. An apparatus as claimed in claim 15, wherein said means for aligning includes means for biasing the insert toward the signature.

17. An apparatus as claimed in claim 11, wherein said applicator means comprises a glue gun having a nozzle for dispensing an adhesive bead on an outwardly facing surface of the signature moving along said conveyor in a substantially horizontal path, means for maintaining the upper edge of the signature generally parallel to the substantially horizontal path whereby the adhesive bead is dispensed in a line generally parallel to the upper edge of the signature 18. An apparatus as claimed in claim 17, wherein said means for maintaining includes a V-type roller disposed to engage the upper edge of the signature.

19. An apparatus as claimed in claim 17, wherein said means for maintaining includes a pair of rollers mounted adjacent said nozzle and disposed to engage the upper edge of the signature, at least one of said rollers being a V-type roller having an outwardly extending wall for engaging an outwardly facing surface of the signature.

20. A signature gathering apparatus comprising:

a conveyor for advancing a plurality of folded signatures in an inverted V orientation along a horizontally extending path;

a plurality of signature feeding stations spaced along said conveyor for depositing signatures seriatim on said conveyor;

a plurality of spaced carrier means on said conveyor for engaging the trailing edge of the signatures and moving the signatures along said conveyor in the horizontally extending path;

applicator means for applying an adhesive bead to a surface of a signature;

positioning means associated with said applicator means for engaging the upper edge of the signature to maintain the upper edge generally parallel to the horizontally extending path;

an insert feeding station including means for discharging an insert onto the signature;

aligning means associated with said discharging means for aligning the insert relative to the signature so that the insert overlies the adhesive bead on the signature and is moved therewith along said conveyor by said carrier means; and pressure means urging the insert against the adhesive bead.

21. A signature gathering apparatus as claimed in claim 20, wherein said aligning means comprising an elongate horizontally extending trough for supporting the lower edge of a discharge insert, means for adjusting the vertical disposition of said trough relative to the signature, and means for guiding the insert in a controlled path from said discharging means to said trough.

22. A signature gathering apparatus as claimed in claim 21, wherein said pressure means includes a roller aligned with the adhesive bead and means for urging said roller toward the insert.

23. A method for attaching an insert onto a signature on a signature gathering line including a conveyor for advancing a signature along a generally horizontal path, a signature feeding station and an insert feeding station spaced along the signature gathering line, comprising the steps of:

depositing a signature from the signature feeding station onto the conveyor in a substantially vertical disposition;

advancing the signature along the conveyor in the generally horizontal path;

engaging the upper edge of the signature to maintain the upper edge substantially parallel to the generally horizontal path;

applying an adhesive on the outwardly facing surface of the signature during the engaging step;

discharging an insert from the insert feeding station onto the outwardly facing surface of the signature;

supporting the lower edge of the insert in a generally horizontal plane at a predetermined vertical disposition relative to the signature to cause the insert to overly the adhesive;

simultaneously advancing the signature and the insert along the conveyor; and pressing the insert against the adhesive attaching the insert to the signature.

24. A method as claimed in claim 23, wherein the adhesive is applied in a predetermined line forming an adhesive bead generally parallel to the upper edge of the signature.

25. A method as claimed in claim 23, including the step of urging the insert into engagement with the adhesive prior to the step of pressing the insert against the adhesive.

* * * * *